United States Patent [19]

Alms et al.

[11] 4,126,855

[45] Nov. 21, 1978

[54] ANNUNCIATOR READOUT UNIT

[75] Inventors: Erhard E. Alms, Lake Zurich; James E. Mitchell, Algonquin, both of Ill.

[73] Assignee: AFE Industries, Inc., Lake Zurich, Ill.

[21] Appl. No.: 745,764

[22] Filed: Nov. 29, 1976

Related U.S. Application Data

[63] Continuation of Ser. No. 576,695, May 12, 1975.

[51] Int. Cl.[2] ..... G08B 5/38

[52] U.S. Cl. ..... 340/381; 40/541; 40/564; 340/521; 340/366 E

[58] Field of Search ..... 340/213 Q, 381, 340, 340/383, 366 E; 40/132 D, 135, 132 R, 130 R, 125 F, 541, 564, 548

[56] References Cited

U.S. PATENT DOCUMENTS

| | | | |
|---|---|---|---|
| 2,749,541 | 6/1956 | Whittlesey | 340/381 |
| 3,107,350 | 10/1963 | Arrasmith | 340/381 |
| 3,594,784 | 7/1971 | Femminella | 340/381 |
| 3,618,078 | 11/1971 | Wittman et al. | 340/381 |
| 3,717,117 | 2/1973 | Stanley | 340/381 |

*Primary Examiner*—John W. Caldwell, Sr.
*Assistant Examiner*—James J. Groody
*Attorney, Agent, or Firm*—Hill, Gross, Simpson, Van Santen, Steadman, Chiara & Simpson

[57] ABSTRACT

An annunciator readout unit for continuously monitoring and indicating to an operator of a machine such as a grain dryer, the condition and stage of the grain drying process and further including warnings and unusual conditions including a grid structure surrounding a plurality of indicating lights with sealing material between the backing plate and the grid structure and further including composite layers of masks, opaque sheets, a thick clear plastic sheet and a top indicating sheet including a mask portion mating with the grid structure and including clear and colored panels overlying the various indicator lights with printed material formed thereon and wherein due to the structure of the composite sheets light from a particular light source does not fringe into adjacent chambers.

7 Claims, 8 Drawing Figures

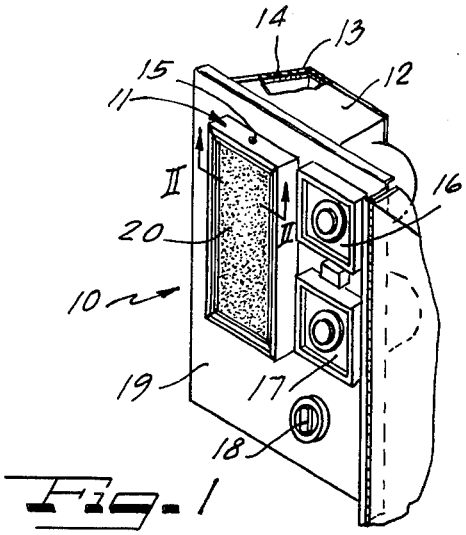
Fig. 1
Fig. 3
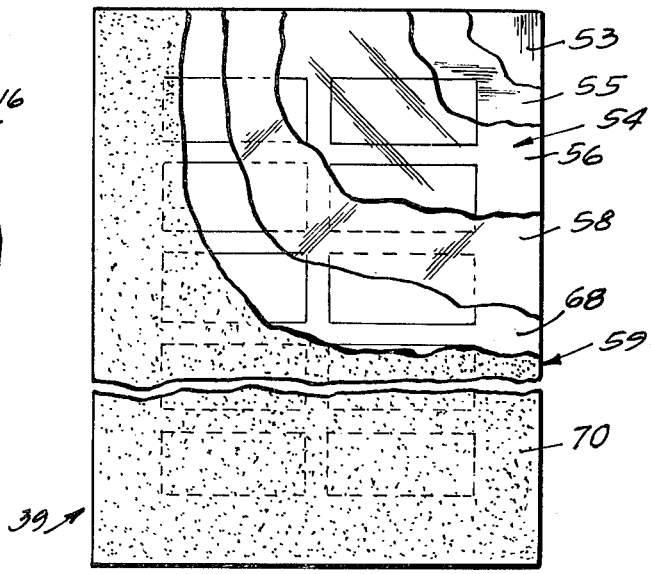
Fig. 2
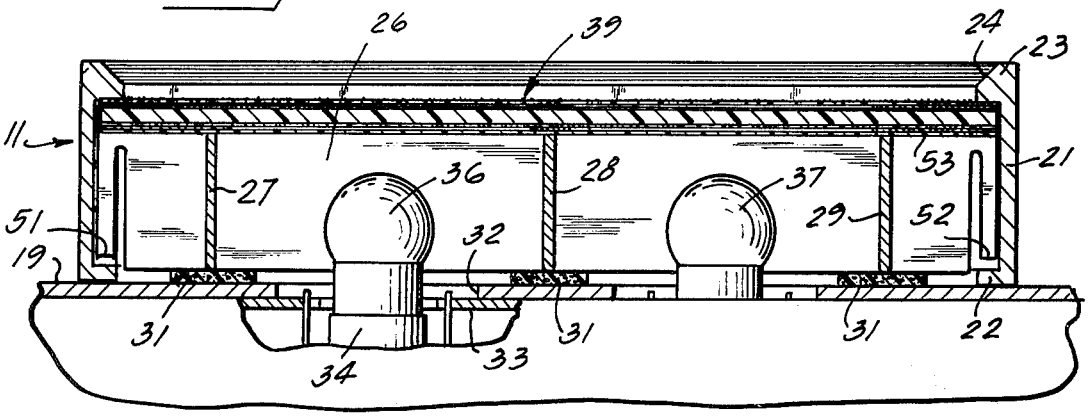
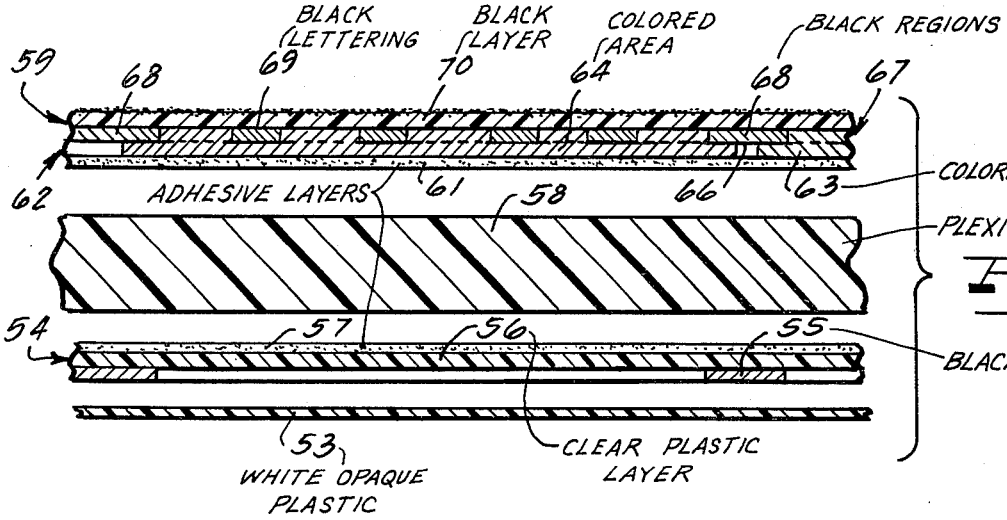
Fig. 4

ANNUNCIATOR READOUT UNIT

This is a continuation of application Ser. No. 576,695, filed May 12, 1975.

BACKGROUND OF THE INVENTION

1. Field of the Invention

This invention relates in general to indicating, warning and monitoring apparatus and in particular to a novel annunciator readout unit for a grain dryer.

2. Description of the Prior Art

It has been known in machines to provide power on indicating lights which when illuminated indicate that power is being applied to the device.

SUMMARY OF THE INVENTION

The present invention provides a novel monitoring, indicating and information giving annunciator panel wherein plurality of indicating cells are provided in an annunciator panel with an indicating light mounted in each of the cells and further including a first opaque sheet mounted above the grid structure which defines the cells and a further second sheet having black outline portions which mate with the partitions of the cells and have clear windows through which light may pass. A third sheet of plexy glass is mounted adjacent the second sheet and a fourth composite sheet formed with black portions which align with the edges of the cells and which has black printing in each of the cell windows and further including clear or colored background for different indications and further includes an opaque cover sheet. The annunciator panel thus formed provides light seals on both sides of the plastic sheet as well as a light seal between the outer edges of the cell walls so that light will not fringe into adjacent cells when a particular indicator light is turned on. Thus, the structure of the invention prevents false indication wherein more than one annunciator cell is illuminated.

The annunciator readout unit can be mounted remotely from the machine or can be mounted on a prominent position where it is continously available for observation by an operator. The stage of operation of the machine and the existence of any emergency conditions are immediately indicated to the operator for his information or action.

Other objects, features and advantages of the invention will be readily apparent from the following description of certain preferred embodiments, thereof, taken in conjunction with the accompanying drawings although variations and modifications may be effected without departing from the spirit and scope with the novel concepts of the disclosure, and in which:

BRIEF DESCRIPTION OF THE DRAWINGS

FIG. 1 is a perspective view of the annunciator assembly of the invention.

FIG. 2 is a sectional view through the annunciator readout unit.

FIG. 3 is a cut-away view showing the various sheets of the invention.

FIG. 4 is a section view illustrating the very sheets of the invention.

DESCRIPTION OF THE PREFERRED EMBODIMENTS

Figure 6:
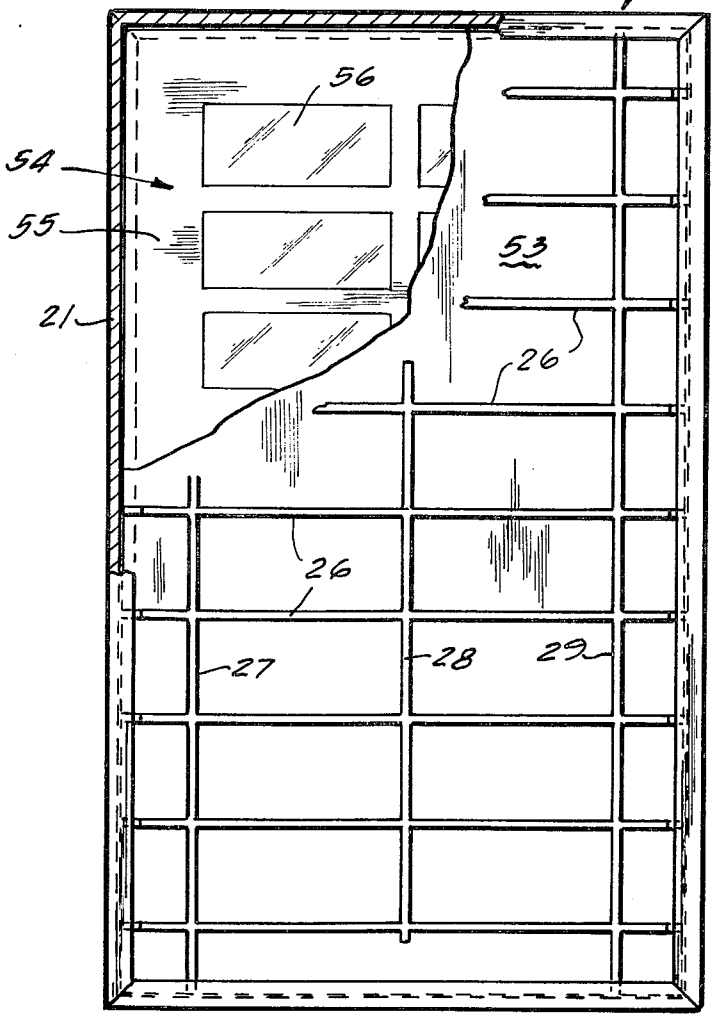
FIG. 6 is a rear view of the annunciator panel.

FIG. 1 illustrates in cut-away perspective the annunciator panel 11 of the invention mounted on a grain dryer 10. The annunciator panel has a front face 20 which appears dark or black when none of the indicator lights in the annunciator panel are lighted and selected regions are illuminated so as to display with color background in black print various indications and warnings so that the operator continuously is able to monitor the operation of the machine such as a grain dryer 10 to which the annunciator panel 11 is attached. The annunciator panel 11 is connected by brackets and set screws 15 to the front panel 19 of the grain dryer machine. Other controls and indicators such as the heat timer 16, the cool timer 17 and the reset switch 18 are also mounted in plate 19. A container 12 with cover plate 13 is attached to the back of plate 19 and a light sealing gasket 14 is mounted between the back cover 13 and the container 12 as shown.

FIGS. 2 through 6 illustrate the internal construction of the annunciator panel 11. FIG. 2 is a horizontal sectional view through the annunciator panel and illustrates that a pair of light bulbs 36 and 37 are mounted in adjacent indicating cells formed in the annunciator panel 11. The base of the light bulb 36 is mounted in a socket 34 which is connected to a plate 33 which is attached to the plate 19. The plate 19 has an opening aligned with the cell into which the light bulb 36 extends. The cells are formed by three vertical strips 27, 28 and 29 and nine horizontal strips 26 for a 16 cell unit. The grid structure formed of the horizontal and vertical strips as illustrated in FIG. 6 is contained in a framework comprising the side channel member 21 that extends around the four sides of the grid structure and is formed with a front bevelled edge 24. The back edge 22 of the assembly rest against the plate 19 as shown in FIG. 2 and the front edge 23 of the channel 22 is adjacent the viewing surface formed of a composite 39 comprising a plurality of viewing layers. The outer edges 51 and 52 of the vertical and horizontal strips of the structure are shortened so that the center portion of the grid structure can firmly engage a foam rubber gasket 31 which provides a light seal between the plate 19 and the grid structure as shown in FIG. 2.

FIG. 4 is a sectional view through the composite 39 illustrating the various sheets which overlie the front portion of the annunciator panel to provide light seals between adjacent cells so that light will not pass from a cell to an adjacent unilluminated cell and also to provide the indication for each cell.

As shown in the exploded sectional view of FIG. 4, the composite 39 is formed of a relatively thin first sheet 53 of white opaque plastic which rests against the outer edges of the ribs 27, 28, 29 and the horizontal ribs 26. Adjacent the opaque plastic layer 53 is a masking layer 54 which is formed with black rib portions 55 which are aligned with the upper edges of the ribs 27, 28, 29 and 26 and which has a clear plastic layer 56 which forms the front viewing portion of each of the cells. In other words, the black regions 55 are aligned with the edges of the ribs 26, 27, 28 and 29 and seal light from adjacent cells but the clear plastic portion 56 allows illumination from a particular cell to pass out through the viewing surface. A layer of adhesive 57 is attached to the clear plastic layer 56 and a relatively thick sheet 58 of clear plastic such as Plexi-glass is attached to the adhesive 57.

A top indicator sheet 59 is formed with an adhesive layer 61 which attaches it to the Plexi-glass sheet 58 and is formed with a second layer 62 which comprise colored areas 63 and 64 which are aligned with all the edges of the ribs 26, 27 and 28 so that there are different colored areas in adjacent cells. Spaces 66 are formed between areas 63 and 64. Another layer 67 has black regions 68 which align with the ribs of the cells and provide light seals. This layer also includes black lettering 69 in which the desired indicating message is printed. The areas 63 and 64 may be clear or may be for example green, yellow, orange or red. A black opaque layer 70 covers the front of the sheet 59 such that when none of the light cells are illuminated the front panel of the annuciator unit presents a uniform dark face.

Figure 5:
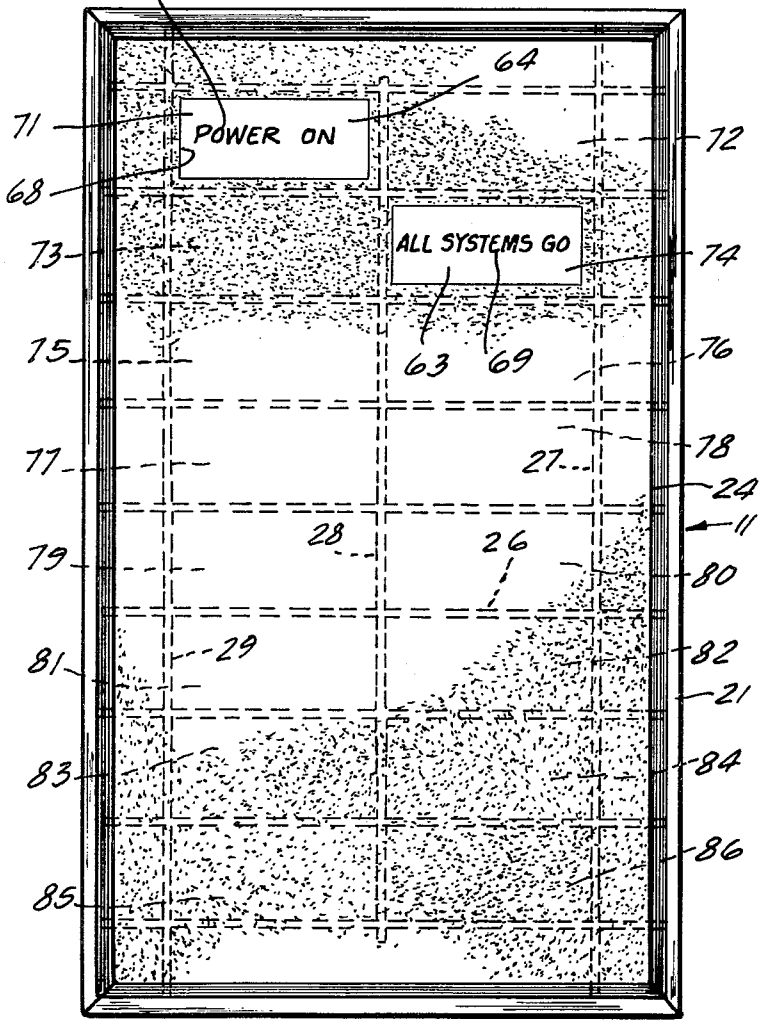
FIG. 5 is a front view of the annunciator readout unit.

FIG. 5 is a front view of the annunciator panel with two of the cells, number 1 and number 4 cells illuminated. The number one cell 71 is surrounded by the black portion 68 of the sheet 59 which also extends out to the edges of the frame member 21 and the black lettering 69 says "POWER ON." The background region 64 for this cell surrounding the letters 69 may be green. The fourth cell 74 has black lettering 69 which says "ALL SYSTEMS GO" and has a background 63 which is green.

In a particular embodiment for a particular grain dryer 16 cells 71 through 86 are utilized and they have the following printing captions and backgrounds of the following colors.

Cell 71 "POWER ON"—Background Green

Cell 72 "TRIAL FOR IGNITION"—Background White

Cell 73 "IGNITION STAND-BY FOR RUNNING-"—Background White

Cell 74 "ALL SYSTEMS GO"—Background Green

Cell 75 LOADING IN PROCESS"—Background Yellow

Cell 76 "CALL FOR REFILL"—Background Orange

Cell 77 "DRYING IN PROCESS"—Background Yellow

Cell 78 "CYCLING VALVE ENERGIZED'-'—Background Orange

Cell 79 "COOLING IN PROCESS"—Background Yellow

Cell 80 "DRYING BIN EMPTY"—Background Orange

Cell 81 "UNLOADING IN PROCESS"—Background Yellow

Cell 82 "STAND-BY FOR UNLOADING"—Background Red

Cell 84 "GAS SUPPLY OUTAGE"—Background Red

Cell 85 "MOTOR OVERLOAD RELAY ACTUATED" Background Red

Cell 86 "GRAIN STORAGE SHUT-DOWN-"—Background Red

It is to be realized, of course, that the individual lights mounted in each of the cell is connected to a switch which may be controlled by a relay which are connected to sensors or transducers for energizing particular lights. For example, when cell 77 light is energized it indicates "DRYING IN PROCESS" and thus the operator knows that the grain dryer is operating under normal conditions. If the supply of gas to the dryer is turned off or disconnected for any reason, transducer illuminates the light in cell 84 so as to indicate "GAS SUPPLY OUTAGE" and this condition is immediately indicated on the annunciator panel for the operator's attention.

Figure 7:
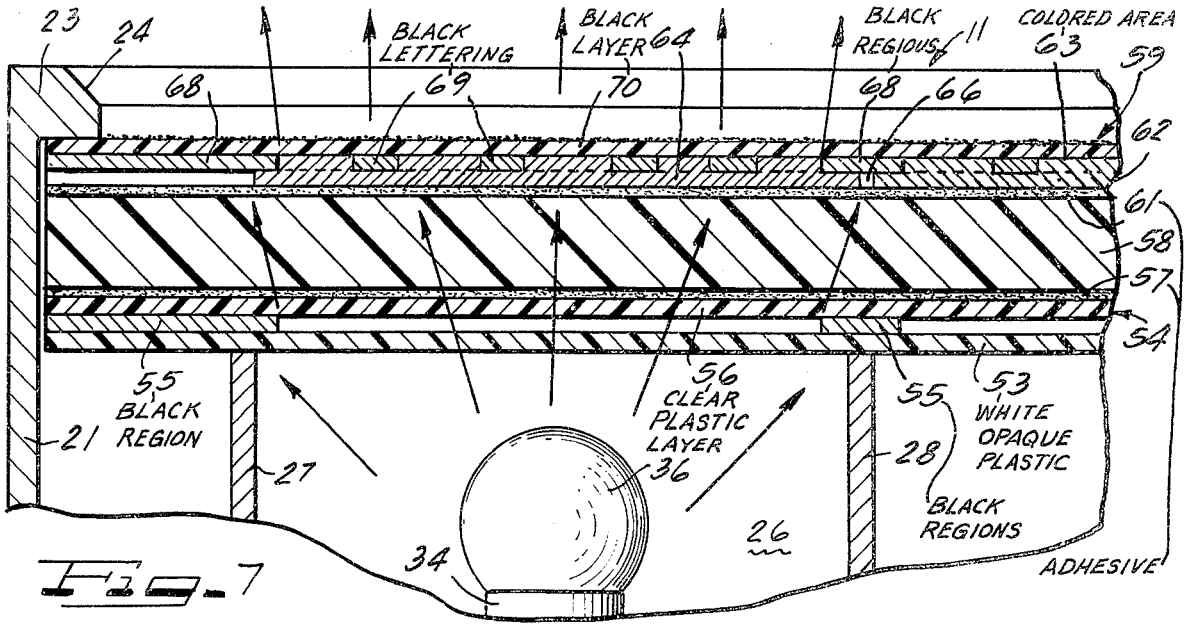
FIG. 7 is an enlarged sectional view.

FIG. 7 illustrates a light 36 illuminated and shows how the light rays are blocked from adjacent cells by the regions 55 and 68 on opposite sides of sheet 58. Thus, false indications will not occur.

Figure 8:
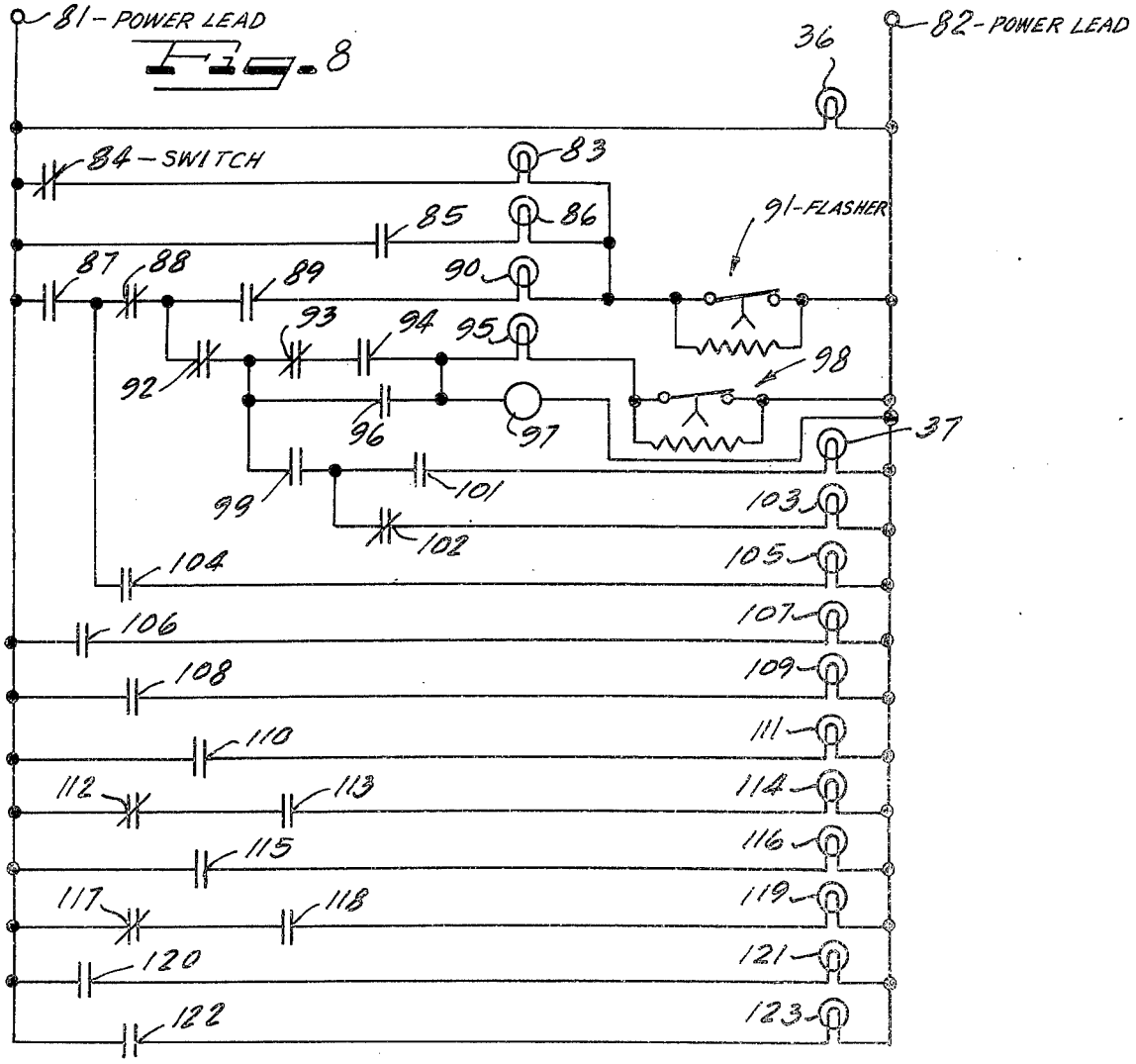
FIG. 8 is an electrical schematic of the invention.

FIG. 8 is an electrical schematic showing power leads across which 12 volt A.C. power may be applied. The "POWER ON" light 36 is illuminated in cell 71 when power is applied to leads 81 and 82. Lights 83, 86, 90, 95, 37, 103, 105, 107, 109, 111, 114, 116, 119, 121 and 123 are selectively illuminated by switches 84, 85, 87, 88, 89, 92, 93, 94, 96, 99, 101, 102, 104, 106, 108, 110, 112, 113, 115, 117, 118, 120, 122 and flashers 91 and 98 to produce the proper indications.

It is seen that this invention provides a novel annunciator indicator panel in a compact manner and in a central location where the various functions of a multifunction machine can be monitored and althouth it has been described with respect to a preferred embodiment thereof the invention is not to be limited to the particular disclosure as modification can be made therein which are within the full intended scope as defined by the appended claims.

We claim as our invention:

1. An annunciator panel comprising, a frame member, a grid structure mounted in said frame member and defining a plurality of indicating cells and formed of a plurality of ribs which define said indicating cells and with edges which define a plane, a plurality of lights mounted in said cells with one light in each cell, a first sheet formed with light blocking areas and mounted so that said light blocking areas are aligned with the edges of said ribs, a relatively thick transparent second sheet mounted adjacent said first sheet, and a third sheet mounted adjacent said second sheet and formed with light blocking area aligned with said edges of said ribs and said third sheet having printed material aligned over said indicating cells defined by said ribs, wherein said third sheet has areas which have different colors in different cells with one color in each cell overlying said printed material in said cells, and wherein said third sheet has a first dark opaque sheet which overlies said indicating cells such that said annunciator panel appears dark unless one of said lights is illuminated.

2. An annunciator panel according to claim 1 including a first layer of adhesive between said first sheet and said thick second sheet.

3. An annunciator panel according to claim 2 including a second layer of adhesive between said thick second sheet and said third sheet.

4. An annunciator panel according to claim 1 including a back panel against which said frame member is mounted and a light sealing gasket aligned with said ribs and said back panel, and said back panel formed with openings through which said plurality of lights extend into said plurality of indicating cells with one light in each cell.

5. An annunciator panel according to claim 1 wherein said first sheet has clear areas between said light blocking areas.

6. An annunciator panel according to claim 4 including a power supply and a plurality of switches with at least one switch connected to each one of said plurality of lights to illuminate said lights in said indicating cells.

7. An annunciator panel according to claim 6 including a flasher connected to at least one of said plurality of switches to cause a light in a cell to flash.

* * * * *